US005269667A

United States Patent [19]

Mauney

[11] Patent Number: 5,269,667

[45] Date of Patent: Dec. 14, 1993

[54] REMOVABE DISCHARGE PORT PLATE FOR A COMPRESSOR

[75] Inventor: Carl R. Mauney, Mooresville, N.C.

[73] Assignee: Ingersoll-Rand Company, Woodcliff Lake, N.J.

[21] Appl. No.: 21,719

[22] Filed: Feb. 24, 1993

[51] Int. Cl.[5] ..... F01C 1/16

[52] U.S. Cl. ..... 418/201.1; 418/1; 418/39

[58] Field of Search ..... 418/39, 201.1, 202, 418/203, 1

[56] References Cited

U.S. PATENT DOCUMENTS

| | | | |
|---|---|---|---|
| 2,311,291 | 3/1967 | Sordy | 418/201.1 |
| 2,755,990 | 7/1956 | Nilsson et al. . | |
| 3,108,740 | 10/1963 | Schibbye . | |
| 4,004,864 | 1/1977 | Schibbye | 418/201.1 |
| 4,120,623 | 10/1978 | Lohn | 418/173 |
| 4,668,159 | 5/1987 | Biordo | 415/74 |

FOREIGN PATENT DOCUMENTS

| | | | |
|---|---|---|---|
| 0200349 | 4/1983 | Fed. Rep. of Germany | 418/201.1 |
| 0227485 | 9/1985 | Fed. Rep. of Germany | 418/201.1 |
| 3609996 | 10/1987 | Fed. Rep. of Germany | 418/201.1 |

*Primary Examiner*—Richard A. Bertsch
*Assistant Examiner*—Charles G. Freay
*Attorney, Agent, or Firm*—Victor M. Genco, Jr.

[57] ABSTRACT

An apparatus includes a rotary compressor having an inlet end, a discharge end, and a predetermined built-in volume ratio. The compressor has at least one rotor which is encased by a housing which is defined by at least a first portion and a second portion. The second housing portion has formed therein a first discharge port dimensioned as a function of the predetermined built-in volume ratio. A removable plate has formed therein a second discharge port dimensioned as a function of the predetermined built-in volume ratio. The removable plate mounts on the housing intermediate the first and second housing portions. When the plate is mounted on the housing the first and second ports cooperatively, fluidly communicate with the discharge end of the compressor.

8 Claims, 2 Drawing Sheets

REMOVABE DISCHARGE PORT PLATE FOR A COMPRESSOR

BACKGROUND OF THE INVENTION

This invention relates generally to compressors, and more particularly to a removable discharge port plate for a positive-displacement, rotary type compressor, such as a rotary-screw compressor, for example.

Typically, housing structures for rotary compressors are manufactured using metal casting methods. These housing structures include a one piece rear housing portion which has cast therein an axial discharge port and a radial discharge port. Previously, the axial discharge port has been sized to accommodate a range of built-in volume ratios. However, a single sized axial discharge port fails to optimize rotary compressor efficiency throughout the range of built-in volume ratios.

The placement of an axial discharge port in a rear compressor housing and the shape of the discharge port are critical for optimizing efficiency in a rotary-screw compressor. However, manufacturing a rear compressor housing by metal casting is not an exact procedure. For example, a core shift may occur in a rear housing mold during the casting process which may cause the axial discharge port to be improperly positioned in the rear housing. Additionally, a defect in the casting process may cause an axial discharge port to be misshaped. In such cases of defective casting, the rear compressor housings must be scraped. Therefore, defective casting causes material waste.

Stepped bores, which receive bearings and rotor shafts, are machined into the rear housing. Presently, two bores of differing diameters must be separately machined into the rear housing. This manufacturing process increases the cost and time necessary to manufacture the rear bearing housing.

During the operating life of a rotary compressor, a rotor may fail causing the cast-in axial discharge port and end face of a rear compressor housing to be scored or otherwise damaged. In such instances, the entire rear compressor housing is scraped to repair the compressor. This, of course, results in material waste.

The foregoing illustrates limitations known to exist in present compressors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus including a compressor having an inlet end, a discharge end, and a predetermined built-in volume ratio. The compressor has at least one rotor which is encased by a housing which is defined by at least a first portion and a second portion. The second housing portion has formed therein a first discharge port dimensioned as a function of the predetermined built-in volume ratio. A removable plate, having formed therein a second discharge port dimensioned as a function of the predetermined built-in volume ratio, mounts on the housing intermediate the first and second housing portions. When the plate is mounted on the housing, the first and second ports cooperatively, fluidly communicate with the discharge end of the compressor.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
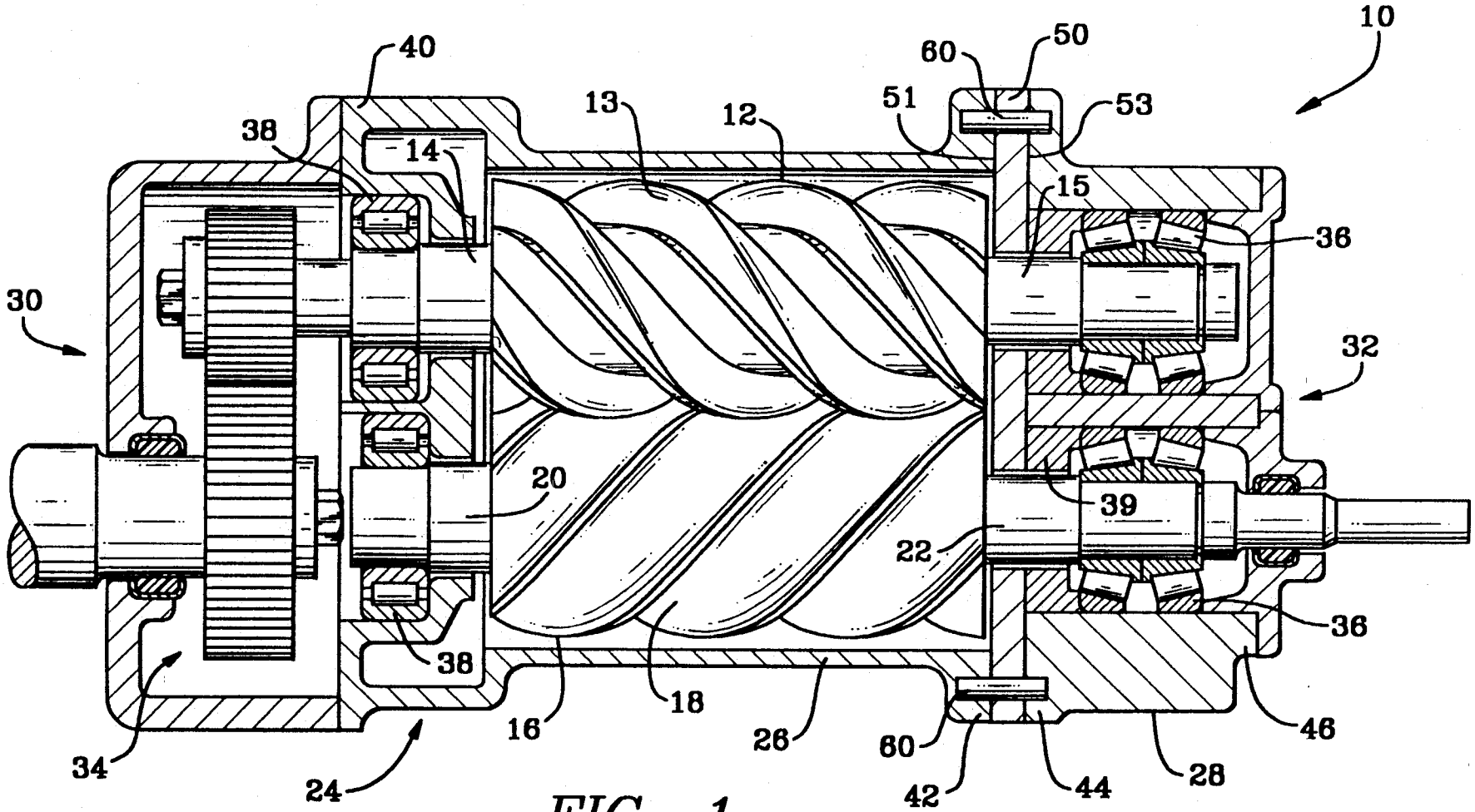
FIG. 1 is a cross-sectional view of a portion of a rotary type, positive-displacement gas compressor showing an embodiment of the invention incorporated therein.

Referring to the drawings, a rotary-screw compressor having a single stage design and having a predetermined built-in volume ratio is illustrated generally at 10. Although the rotary-screw compressor is illustrated as a single stage design, it is anticipated that the teachings of the present invention are equally applicable to rotary-screw compressors having a multi-stage design. The term rotary-screw compressor, as used hereinafter, applies to rotary-screw pumps and rotary-screw compressors as well as any rotary-screw device which displaces a working fluid by rotary screw action. A working fluid, as used hereinafter, is intended to cover any fluid including gases, such as air.

The rotary-screw compressor 10 includes a first helical rotor 12 having a plurality of lobes 13, a first end shaft 14, and an axially opposed second end shaft 15. The first helical rotor 12 is defined by a predetermined length and helix angle. The rotary compressor 10 further includes a second helical rotor 16 having a plurality of grooves 18, a first end shaft 20, and an axially opposed second end shaft 22. The second helical rotor is defined by a predetermined length and helix angle. The first and second helical rotors, 12, 16, are mounted for operation in a housing 24. The housing 24 is defined by at least a first housing portion or structure 26 and a second housing portion or structure 28. The housing 24 provides for a compressor inlet end 30 and a compressor discharge end 32. During operation, the first helical rotor 12 mates with the second helical rotor 16 in intermeshing, compressing relation within the housing 24 as is well known in the art.

Mounted on the first end 14 of the first helical rotor 12 is a gearing system 34 which is disposed in force receiving relation to a prime mover (not illustrated). In this specification, the term "prime mover" is intended to cover diesel engines as well as other internal combustion engines, turbines, and electric motors or any device which adds a motive force to the gearing system 34.

As illustrated in FIG. 1, each of the first and second helical rotors, 12, 16, is rotatably supported by the combination of rolling element bearings and spacers. In this regard, a predetermined number of bearings 36 are positioned on the second ends 15, 22, of the first and second helical rotors. The bearings 36 take the first and second rotors, axial thrust, carry radial loads, and provide for requisite small axial running clearances. Further, a predetermined number of bearings 38 are positioned on the first ends, 14, 20, of the first and second helical rotors. The bearings 38 are typically floating bearings, which allow for unequal thermal expansion of the first and second helical rotors and the housing. The second ends 15, 22 are also each rotatably supported by a spacer 39.

As seen by reference to FIG. 1, the second housing portion 28 has formed therein a pair of bores which are each defined by a single diametral dimension. The bores are individually operable to house a respective second end 15, 22, a bearing 36, and a spacer 39.

The first housing portion 26 includes a first end 40 and a second end 42. The first end 40 is generally disposed at the inlet end 30 of the compressor 10. The second housing portion 28 includes a first end 44 and a second end 46. The second housing portion 28 removeably mounts on the first housing portion 26 as will be described in further detail hereinafter. A radial or first discharge port 48 is formed in the second end 42 of the first housing 26, as best seen by reference to FIG. 2. The first discharge port 48 is dimensioned as a function of the predetermined built-in volume ratio of the rotary-screw compressor 10.

Figure 3:
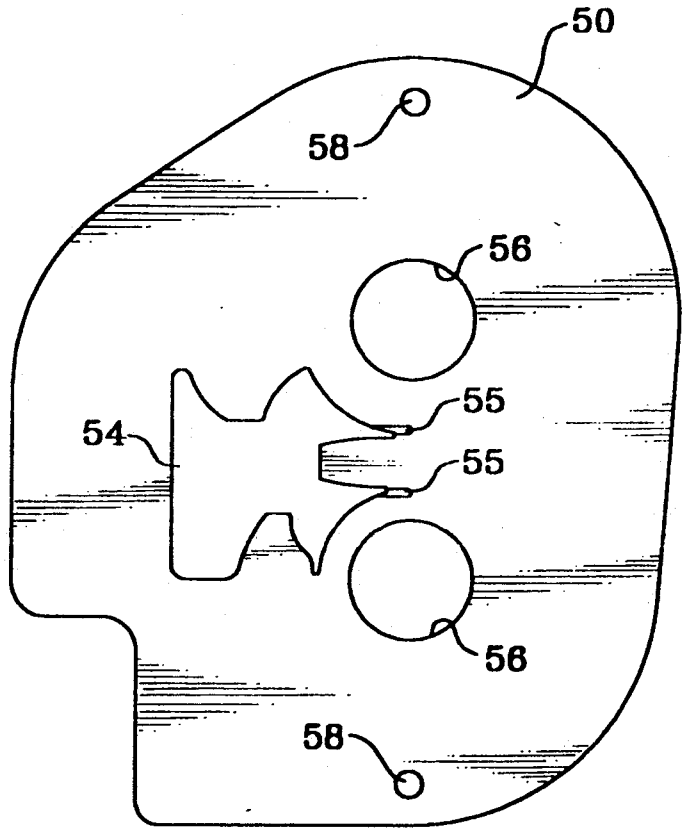
FIG. 3 is a side elevational view of a plate 50.
Figure 2:
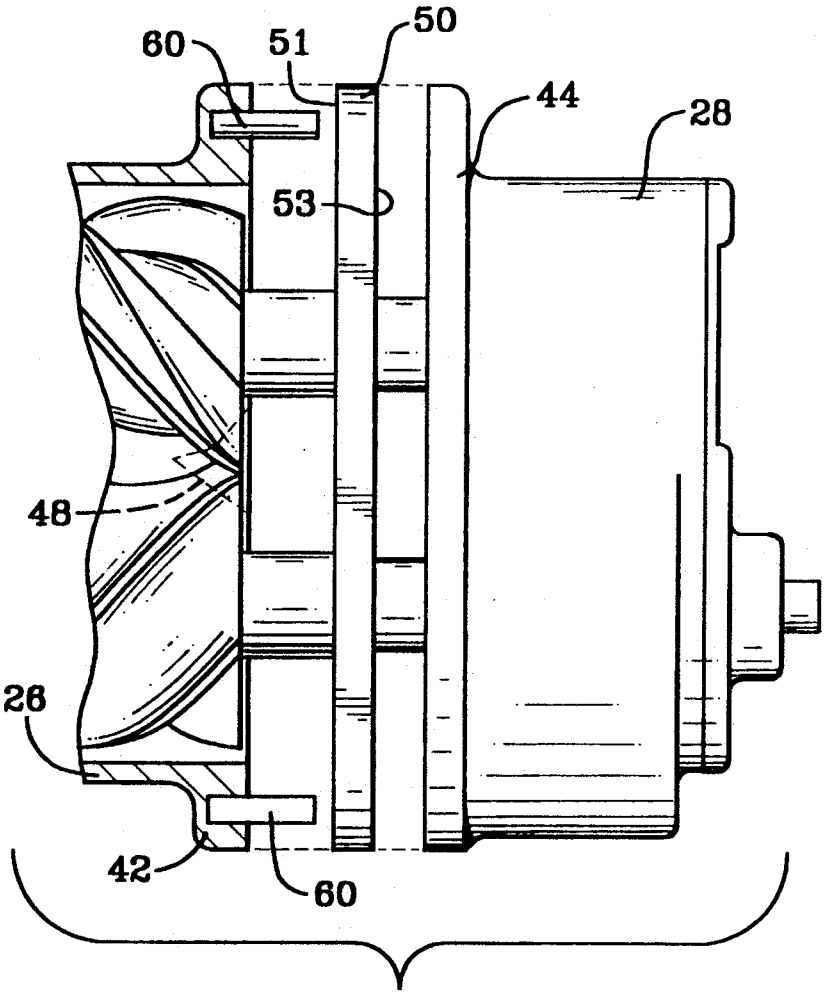
FIG. 2 is a partial, exploded view of the device illustrated in FIG. 1.

Removeably mounted intermediate the first and second housing portions 26, 28, is a means for optimizing an operating efficiency of the rotary-screw compressor 10. The means for optimizing the compressor operating efficiency is illustrated in FIGS. 1, 2 and 3 as a plate 50 having a substantially planar main body defined by a first surface 51 and a second surface 53. Formed in the plate 50, in a precise and predetermined location, is an axial or second discharge port 54, a pair of relief slots 55, a first pair of apertures 56 and a second pair of apertures 58. The plate 50 removeably mounts on the housing 24, intermediate the first and second housing portions, by any suitable fastening technique, such as by threaded fasteners (not shown). When mounted on the housing 24, the first surface 51 of the plate 50 abuts the second end 42 of the first housing 26, and the second surface 53 of the plate abuts the first end 44 of the second housing 28.

The axial discharge port 54 is precisely dimensioned as a function of the predetermined built-in volume ratio of an individual rotary-screw compressor 10 to optimize the efficiency of the rotary-screw compressor 10. The axial discharge port 54 is precisely formed in the plate 50 by any suitable manufacturing technique, such as by a metal stamping technique or by water jet cutting for example.

The discharge plate 50 is precisely positioned for operation on the housing 24 by action of the second pair of apertures 58 in combination with a pair of dowel members 60. More particularly, each aperture 58 individually receives an individual dowel 60 to thereby properly position and align the plate 50 on the housing 24. As should be understood, the first pair of apertures 56 individually receive a respective second end shaft 15, 22, of the first and second rotors 12, 16. When the plate 50 is properly positioned on the housing 24, the first and second discharge ports, 48, 54, cooperatively fluidly communicate with the discharge end 32 of the rotary screw compressor 10.

In operation, a user will select a plate 50 having an axial discharge port 54 which is specifically dimensioned to accommodate a rotary-screw compressor 10 which has been placed into service at a predetermined pressure output. In order to select a suitable plate 50, the pressure ratio at which the rotary-screw compressor 10 will be put into service is first determined. Thereafter, the built-in volume ratio is calculated using formulae which are known. Having calculated a built-in volume ratio, the dimensions of the axial discharge port 54 may be calculated, whereby a suitable plate 50 is selected to be mounted on the housing 24 of the rotary-screw compressor 10. Efficiency is optimized in the rotary-screw compressor 10 by providing a plate 50 having an axial discharge port 54 which is specifically dimensioned to accommodate the predetermined pressure output.

While this invention has been illustrated and described in accordance with a preferred embodiment, it is recognized that variations and changes may be made therein without departing from the invention as set forth in the following claims.

Having described the invention, what is claimed is:

1. A housing for a rotary compressor, the compressor having an inlet end, a discharge end, and a predetermined built-in volume ratio, the compressor including at least one rotor, the housing comprising:

a first structure;

a second structure which removeably mounts on the first structure, the second structure having formed therein a first discharge port dimensioned as a function of the predetermined built-in volume ratio, the first and second structures encasing the rotor having a first and second end shaft, the second structure having further formed therein at least one bore which is defined by a single diametral dimension, the at least one bore housing the second end shaft of the at least one rotor;

a first spacer means for rotatably supporting the second end shaft of the at least one rotor within the at least one bore; and means for optimizing an operating efficiency of the compressor which removably mounts on the housing intermediate the first and second structures, the efficiency optimizing means having a second discharge port dimensioned as a function of the built-in volume ratio, the first and second ports cooperatively, fluidly communicating with the discharge end of the compressor.

2. A housing for a rotary compressor, the compressor having an inlet end, a discharge end, and a predetermined built-in volume ratio, the compressor including at least one rotor, the housing comprising:

a first structure;

a second structure which removeably mounts on the first structure, the second structure having formed therein a first discharge port dimensioned as a function of the predetermined built in volume ratio, the first and second structures encasing the rotor having a first and second end shaft, the second structure having further formed therein at least one bore which is defined by a single diametral dimension, the at least one bore housing the second end shaft of the at least one rotor;

a first spacer means for rotatably supporting the second end shaft of the at least one rotor within the at least one bore;

a removable plate having formed therein a second discharge port, and a first pair of apertures which each receive a respective second end shaft of the first and second helical rotors, the second discharge port being dimensioned as a function of the predetermined built-in volume ratio, and wherein the removeable plate mounts on the housing intermediate the first and second structures, and when mounted thereon, the first and second discharge ports cooperatively, fluidly communicate with the discharge end of the compressor.

3. A housing for a rotary compressor, the compressor having an inlet end, a discharge end, and a predetermined built-in volume ratio, the compressor including at least a first helical rotor and a second helical rotor, each helical rotor including axially opposed first and second end shafts, the second end shafts being positioned at the discharge end of the compressor, the housing comprising:

a first structure;

a second structure which removeably mounts on the first structure, the second structure having formed therein a first discharge port dimensioned as a function of the predetermined built-in volume ratio, the first and second structures encasing the first and second helical rotors; and a removable plate having formed therein a second discharge port, a first pair of apertures which each receive a respective second end shaft of the first and second helical rotors, and a second pair of apertures which each receive a respective dowel means for aligning the plate on the housing, the second port dimensioned as a function of the predetermined built-in volume ratio, and wherein the removeable plate mounts on the housing intermediate the first and second structures, and when mounted thereon, the first and second ports cooperatively, fluidly communicate with the discharge end of the compressor.

4. A housing for a rotary compressor, as claimed in claim 3, and wherein the second structure includes a pair of bores which are each defined by a single diametral dimension, and wherein the bores are individually operable to house a respective second end shaft of the first and second helical rotors, the second end shafts each being rotatably supported within a respective bore by a spacer.

5. A method for optimizing an operating efficiency of a rotary screw compressor throughout a range of built-in volume ratios, the rotary screw compressor having a housing which includes a first structure and a second structure which removeably mounts on the first structure, and wherein a removable plate mounts on the housing intermediate the first and second structures, the method comprising the steps of:

determining a pressure ratio at which the rotary screw compressor will operate;

calculating a built-in volume ratio of the rotary screw compressor; and dimensioning a discharge port in the removeable plate as a function of the calculated built-in volume ratio to optimize the operating efficiency of the rotary screw compressor.

6. A method for optimizing an operating efficiency of a rotary screw compressor throughout a range of built-in volume ratios, as claimed in claim 5, and wherein the discharge port, which is dimensioned in the removeable plate, is an axial discharge port.

7. A method for optimizing an operating efficiency of a rotary screw compressor throughout a range of built-in volume ratios, the rotary screw compressor having a housing which includes a first structure and a second structure which removeably mounts on the first structure, and wherein a removable plate mounts on the housing intermediate the first and second structures, the method comprising the steps of:

dimensioning a discharge port in the removeable plate as a function of a predetermined built-in volume ratio to optimize the operating efficiency of the rotary screw compressor.

8. A method for optimizing an operating efficiency of a rotary screw compressor throughout a range of built-in volume ratios, as claimed in claim 7, and wherein the discharge port, which is dimensioned in the removeable plate, is an axial discharge port.

* * * * *